US007148181B2

(12) United States Patent
Tanaka et al.

(10) Patent No.: US 7,148,181 B2
(45) Date of Patent: Dec. 12, 2006

(54) THERMOSENSITIVE RECORDING MEDIUM

(75) Inventors: Kazunori Tanaka, Osaka (JP); Masato Inoue, Osaka (JP); Eiji Satake, Osaka (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 11/152,173

(22) Filed: Jun. 15, 2005

(65) Prior Publication Data

US 2005/0233903 A1 Oct. 20, 2005

Related U.S. Application Data

(62) Division of application No. 10/372,124, filed on Feb. 25, 2003, now abandoned.

(51) Int. Cl.
*B41M 5/40* (2006.01)

(52) U.S. Cl. ..... 503/200; 427/152; 503/226

(58) Field of Classification Search ..... 427/152; 503/200, 226

See application file for complete search history.

(56) References Cited

U.S. PATENT DOCUMENTS 4,895,828 A * 1/1990 Yaguchi et al. ..... 503/226
4,929,590 A 5/1990 Maruta et al. ..... 503/207
5,418,006 A 5/1995 Roth et al. ..... 427/154
6,861,115 B1 * 3/2005 Morris et al. ..... 428/32.36

FOREIGN PATENT DOCUMENTS

| | | |
|---|---|---|
| EP | 0 959 102 | 11/1999 |
| JP | 59-225987 | 12/1984 |
| JP | 1-113282 | 5/1989 |
| JP | 4-241987 | 8/1992 |
| JP | 2630945 | 4/1997 |
| JP | 11-302561 | 11/1999 |

OTHER PUBLICATIONS

European Search Report dated Aug. 6, 2003.

* cited by examiner

*Primary Examiner*—Bruce H. Hess
(74) *Attorney, Agent, or Firm*—Armstrong, Kratz, Quintos, Hanson & Brooks, LLP

(57) ABSTRACT

An aqueous resin composition used to form an undercoat layer of a thermosensitive recording medium, comprising a water-repellent filler (A) having a water-repellent surface, which is composed of at least one of an organosilicon compound and an organofluorine compound, and an aqueous solution or water dispersion of a film-forming resin (B), which contains the water-repellent filler (A).

6 Claims, No Drawings

THERMOSENSITIVE RECORDING MEDIUM

This application is Divisional Application of prior application Ser. No. 10/372,124, filed on Feb. 25, 2003 now abandoned, which is hereby incorporated by reference.

BACKGROUND OF THE INVENTION

1. Field of the Invention

The present invention relates to an aqueous resin composition used to form an undercoat layer of a thermosensitive recording medium having excellent performance. More particularly, the present invention relates to an aqueous resin composition used to form an undercoat layer of a thermosensitive recording medium, which has high dynamic color developing sensitivity and excellent head-matching properties and is capable of recording uniform and clear images with high density, by providing an intermediate layer (hereinafter referred to as an "undercoat layer") between a support made of a paper or polyethylene terephthalate (PET) and a thermosensitive color developing layer, and to a thermosensitive recording medium.

2. Description of the Related Art

With rapid increase in amount of information, variation of kinds, resource conservation, and social demands such as environmental response, various recording materials have been put into practical use in the field of information recording. Among these, a thermosensitive recording medium is widely used in the fields of printers (computer output, desk-top calculators, etc.), recorders for medical measurement, low-speed and high-speed facsimiles, automatic ticket vendors, thermal copying machines and labels for POS (electronic cash register) systems because of the following advantages:

(1) complicated developing processes of the prior art are not required because color-developed images are recorded only by heating, (2) recording can be conducted by using relatively simple and compact apparatus and the thermosensitive recording medium is easily handled and requires low maintenance costs, (3) cost is low because a paper can be used as a support, and (4) feel of the resulting recording material resembles that of plain paper.

The above thermosensitive recording medium is commonly produced by applying a thermosensitive color developing resin composition containing color developing component capable of causing the color development reaction due to heat on a support made of a paper, a synthetic paper or a synthetic resin film and drying the thermosensitive color developing resin composition, and color-developed images are recorded by heating the thermosensitive recording medium thus obtained using a thermal recording device such as a heat stylus or a thermal head.

A conventional thermosensitive recording medium had a problem in that color developing sensitivity, namely, "dynamic color developing sensitivity" is insufficient when a thermal head is driven at high speed.

To solve such a problem, for example, Japanese Patent Application, First Publication No. Hei 1-13282 A proposes a method of using plastic spherical hollow particles having an average particle diameter of 0.2 to 1.5 μm and a hollow percentage of 40 to 90% in an undercoat layer. However, this method was not a satisfactory method because of poor flexibility of the wall material of hollow particles or poor thermal insulation properties due to poor expandability, and poor approachability between the thermal head and the thermosensitive recording medium.

Also Japanese Patent Application, First Publication No. Hei 4-241987 A proposes a method of using a fine hollow filler having a volumetric hollow ratio of 90% or more in an undercoat layer. However, there was the following problem. As the hollow ratio of tile hollow filler increases, thermal insulation properties are enhanced and the sensitivity is improved; however, the specific gravity of the filter itself is reduced. When a composition (coating solution) for an undercoat layer is made using the filler, concentration gradient of the hollow filler occurs at the portion over the liquid and the portion under the liquid over time, and thus the hollow filler on the liquid level is dried, bonded and coagulated.

Furthermore, the thermosensitive recording medium had a problem in that homogeneous images were difficult to obtain because the surface of the undercoat layer has poor smoothness.

As a means for solving the problem, various proposals are made in Japanese Patent Application, First Publication No. Sho 59-225987 A and Japanese Patent No. 2630945. For example, a technique of laminating a foamed layer obtained by foaming a foamable plastic filler with an undercoat layer containing a filler and a binder and a technique of adding inorganic and organic fillers to a foamable plastic filler are proposed. The former technique has a problem such as a complicated manufacturing process, while the latter technique has a problem such as increased cost with an increase in kinds of raw materials, and thus there have never been obtained results which meet all demands for quality, cost, and manufacturing process of the thermosensitive recording medium.

The foamable plastic filler used in the latter technique is a hollow filler comprising a shell made of a thermoplastic substance and a low-boiling point organic solvent such as propane or isobutane contained in the shell, and evolves a carbon dioxide gas or an organic gas into an air when foamed by heating. This fact goes against the trend of recent reduction of the environmental burden and is one of problems which should be considered with respect to a means for reducing the environmental burden of raw materials used in the undercoat layer.

SUMMARY OF THE INVENTION

An object of the present invention is to provide a thermosensitive recording medium which has high dynamic color developing sensitivity and excellent head-matching properties and is capable of recording uniform and clear images with high density.

Another object of the present invention is to provide an environmentally friendly aqueous resin composition, which does not contain a foamable plastic filler capable of evolving a carbon dioxide gas or an organic gas and therefore exerts no adverse influence on the environment, as a material used to form an undercoat layer, constituting the thermosensitive recording medium.

Still another object of present invention is to provide a method of producing the thermosensitive recording medium using the aqueous resin composition.

The present inventors have intensively studied to achieve the above objects and found the following novel technical findings:

(1 ) when using an aqueous resin composition comprising a water-repellent filler (A) having a water-repellent surface, which is composed of at least one of an organosilicon compound and an organofluorine compound, and an aqueous solution or water dispersion of a film-forming resin (B), surprisingly, it is made possible to form an undercoat layer having microvoids and excellent thermal insulation properties merely by applying the aqueous resin composition on the support and drying the aqueous resin composition, and thus the microvoids are formed at the interface between the film-forming resin (B) and the water-repellent filler (A); and (2) a thermosensitive recording medium produced by applying a thermosensitive color developing aqueous resin composition containing a thermosensitive color developing component in an aqueous solution or a water dispersion of a film-forming resin on the undercoat layer and drying the thermosensitive color developing aqueous resin composition to form a thermosensitive color developing layer has high color developing sensitivity and excellent head-matching properties and is capable of recording uniform and clear images with high density.

The present invention has been completed based on the above technical findings.

The present invention provides an aqueous resin composition used to form an undercoat layer of a thermosensitive recording medium, comprising a water-repellent filler (A) having a water-repellent surface, which is composed of at least one of an organosilicon compound and an organofluorine compound, and an aqueous solution or water dispersion of a film-forming resin (B).

Also the present invention provides a method of producing a thermosensitive recording medium, which comprises the process (1) of applying the aqueous resin composition on a support and drying the aqueous resin composition to form an undercoat layer which is composed of a matrix of a film-forming resin (B) and a water-repellent filler (A) dispersed in the matrix and has microvoids at the interface between the matrix and the watery-repellent filler (A); and the process (2) of applying a thermosensitive color developing aqueous resin composition containing a thermosensitive color developing component in an aqueous solution or a water dispersion of a film-forming resin on tile undercoat layer and drying the thermosensitive color developing aqueous resin composition to form a thermosensitive color developing layer.

Furthermore, the present invention provides a thermosensitive recording medium comprising a support, and an undercoat layer and a thermosensitive color developing layer, which are sequentially laminated on the support, wherein the undercoat layer is composed of a matrix of a film-forming resin (B) and a water-repellent filler (A) dispersed in the matrix, the water-repellent filler (A) having a water-repellent surface composed of at least one of an organosilicon compound and an organofluorine compound, and also has microvoids at the interface between the matrix and the water-repellent filler (A).

DETAILED DESCRIPTION OF THE PREFERRED EMBODIMENTS

The present invention will now be described in detail.

First, the aqueous resin composition used to form the undercoat layer of the thermosensitive recording medium of the present invention will be described. The aqueous resin composition contains a water-repellent filler (A) having a water-repellent surface, which is composed of at least one of an organosilicon compound and an organofluorine compound, in an aqueous solution or water dispersion of a film-forming resin (B).

As the water-repellent filler (A), a filler having essentially high water repellency made of a methylsilicone resin, or an inorganic or organic filler having high water repellency which is imparted by subjecting the filler to a surface treatment using an organosilicon compound or an organofluorine compound. To exert the effects of the present invention, more effectively, a moisture adsorption ratio of the filler is preferably at most 2% by weight tinder the conditions of a temperature of 20° C. and a relative humidity of 80%.

Examples of the organosilicon compound used to form the water-repellent surface to the filler include halosilane compound such as methyltrichlorosilane or dimethylchlorosilane; alkoxysilane compound such as hexyltrimethoxysilane, octyltrimethoxysilane or decyltrimethoxysilane; silazane compound such as hexamethyldisilazane; and unmodified, or polyether-modified, methylstyryl-modified, higher fatty acid ester-modified, alkyl-modified or fluorine-modified silicone oil having a polydimethylsiloxane skeleton.

Examples of the organofluorine compound used to form the water-repellent surface on the filler include fluorine atom-containing organosilicon compound wherein hydrogen atoms of the halosilane compound, alkoxysilane compound or silazane compound are partially or completely replaced by fluorine atoms, and/or fluorine oil and fluoroalkyl group-containing oligomer.

Among these, water-repellent silica whose surface is subjected to a water repellency treatment using the organosilicon compound and/or the organofluorine compound, or a methylsilicone resin having high water repellency is particularly preferred.

The moisture adsorption ratio as measured under the conditions of a temperature of 20° C. and a relative humidity of 80% is preferably 2% by weight or less because microvoids are formed more satisfactorily at the interface between the water-repellent filler (A) and the film-forming resin (B) when the undercoat layer is formed. In this case, it is made possible to prevent problems in that poor thermal insulation properties cause release of thermal energy from a thermal recording device such as a thermal head through the support, resulting in poor sensitivity.

As used herein, "moisture adsorption ratio as measured under the conditions of a temperature of 20° C. and a relative humidity of 80%" means a value (percentage) obtained in the following manner. That is, a fixed amount of a sample is allowed to stand for 2 hours under the conditions of a temperature of 20° C. and a relative humidity of 80% and, after weighing about 1 g of the sample using a precision chemical balance, drying at 105° C. for 2 hours and air-cooling in a desiccator for 30 minutes, the weight of the sample is measured and a change in weight before and after drying is divided by an initial weight to obtain a moisture adsorption ratio (%).

The average particle diameter of the water-repellent filler (A) used in the present invention can be appropriately controlled according to the objective color developing sensitivity of the thermosensitive recording medium, but is preferably 10 μm or less for the purpose of maintaining surface smoothness of the undercoat layer and maintaining matching properties with the thermal recording equipment such as thermal head during thermosensitive printing. When the average particle diameter is 10 μm or less, surface smoothness after coating and drying can be maintained and the effect of improving the sensitivity can be expected without lowering approachability with the thermal recording device such as a thermal head. The average particle diameter is particularly preferably 5 μm or less because voids with the film-forming resin (B) are efficiently formed in order to make the undercoat layer to serve as a thermal insulation layer for improving color developing sensitivity due to efficient practical use of thermal energy from the thermal head.

The film-forming resin (B) used in the aqueous resin composition of the present invention fulfill an important role of forming microvoids in the undercoat layer and maintaining integrity between the undercoat layer and the surface of the support and integrity between the thermosensitive color developing layer and the undercoat layer.

As the film-forming resin (B), a water-dispersible or water-soluble polymer compound can be used. In view of water resistance, plasticizer resistance and barrier properties, a water-dispersible polymer compound is preferred. Specifically, there can be used water-soluble polymer compounds, for example, polyvinyl alcohol, modified polyvinyl alcohol, starch and derivatives thereof, cellulose derivatives such as methylcellulose, hydroxyethylcellulose, carboxymethylcellulose, methylcellulose or ethylcellulose, sodium polyacrylate, polyvinyl pyrrolidone, acrylamide-acrylate ester copolymer, acrylamide-acrylate ester-methacrylate ester terpolymer, alkali salt or ammonium salt of styrene-maleic anhydride copolymer, alkali salt or ammonium salt of isobutylene-maleic anhydride copolymer, alkali salt or ammonium salt of ethylene-maleic anhydride copolymer, polyacrylamide, sodium alginate, gelatin and casein; and water-dispersible polymer compounds such as polyurethane resin, polyester resin, polyvinyl chloride resin, ethylene-vinyl chloride copolymer, polyacrylate ester resin, styrene-butadiene copolymer, styrene-butadiene-acrylate ester copolymer, acrylonitrile-butadiene copolymer, acrylate ester-butadiene copolymer, ethylene-vinyl acetate copolymer, vinyl acetate resin, vinyl acetate-acrylate ester copolymer and styrene-acrylate ester copolymer.

Among these, water-dispersible polyurethane resin, polyacrylate esters, styrene-butadiene copolymer, acrylonitrile-butadiene copolymer and acrylate ester-butadiene copolymer are particularly preferred in view of water resistance, plasticizer resistance and barrier properties.

These film-forming resins (B) may be used alone, or two or more kinds of them may be used in combination.

The amount of the water-repellent filler (A) in the aqueous resin composition used to form the undercoat layer of the thermosensitive recording medium of the present invention is preferably within a range from 3 to 100 parts by weight, and particularly preferably from 5 to 50 parts by weight, based on 100 parts by weight of the film-forming resin (B).

When the amount of the water-repellent filler (A) is within a range from 3 to 100 parts by weight based on 100 parts by weight of the film-forming resin (B), it is made possible to impart excellent dynamic color developing sensitivity, excellent image uniformity, excellent head-matching properties, excellent integrity between the support and the undercoat layer and excellent integrity between the undercoat layer and the thermosensitive color developing layer.

In the aqueous resin composition used to form the undercoat layer of the thermosensitive recording medium of the present invention, conventionally known auxiliary additive components used in this kind of the thermosensitive recording medium, for example, thermally fusible substances, leveling agents and thickeners can be used in combination, if necessary.

Examples of the thermally fusible substance include higher fatty acids, esters, amides or metal salts thereof, various waxes, condensate of aromatic carboxylic acid and amine, phenyl benzoate, higher straight-chain glycol, dialkyl 3,4-epoxy-hexahydrophthalate and higher ketone. Among these, substances having a melting point within a range from 50 to 200° C. are preferred. These substances may be used alone, or two or more kinds of them may be used in combination.

Examples of the leveling agent include, but are not limited to, conventionally known leveling agents, for example, nonionic hydrocarbon surfactants such as polyoxyethylene alkyl ether, polyoxyethylene fatty acid ester, polyoxyethylene alkyl phenyl ether, sorbitan fatty acid ester, polyoxyethylene sorbitan fatty acid ester, polyoxyethylene alkylamine ether, fatty acid diethanolamide and sucrose ester; anionic hydrocarbon surfactants such as dialkyl sulfosuccinate ester, polyoxyethylene alkyl ether sulfate, higher alkyl ether sulfate ester salt and phosphate ester salt; cationic hydrocarbon surfactants such as quaternary ammonium salt (e.g., alkyl trimethylammonium chloride, etc.); amphoteric hydrocarbon surfactants such as dimethyl alkyl lauryl betaine, alkylglycine and amide betaine; polymeric hydrocarbon surfactants such as imidazoline type polyoxyethylene polyoxypropylene block polymer; acetylene glycol special surfactant; silicone surfactants; and fluorine surfactants. These leveling agents may be used alone, or two or more kinds of them may be used in combination.

Examples of the thickener include, but are not limited to, conventionally known thickeners, for example, cellulose derivative such as hydroxyethylcellulose, methylcellulose or carboxymethylcellulose, polyacrylate, polyvinyl pyrrolidone, and association type polymeric surfactant such as urethane or polyether. These thickeners may be used alone, or two or more kinds of them may be used in combination.

Examples of the method of preparing the aqueous resin composition used to form the undercoat layer of the thermosensitive recording medium of the present invention include a method of mechanically dispersing in an aqueous solution or water dispersion of the water-repellent filler (A) and the film-forming resin (B) using a homogenizer, and a method of dispersing using a surfactant.

In this case, optionally used auxiliary additives may be added before or after the mechanical dispersion, and the aqueous resin composition may be appropriately prepared.

The thermosensitive recording medium of the present invention will now be described.

The thermosensitive recording medium of the present invention comprises a support, and an undercoat layer and a thermosensitive color developing layer, which are sequentially laminated on the support, wherein the undercoat layer is composed of a matrix of a film-forming resin (B) and a water-repellent filler (A) dispersed in the matrix, the water-repellent filler (A) having a water-repellent surface composed of at least one of an organosilicon compound and an organofluorine compound, and also has microvoids at the interface between the matrix and the water-repellent filler (A).

The thermosensitive recording medium of the present invention can be produced by the process (1) of applying the aqueous resin composition on a support and drying the aqueous resin composition to form an undercoat layer which is composed of a matrix of a film-forming resin (B) and a water-repellent filler (A) dispersed in the matrix and has microvoids at the interface between the matrix and the water-repellent filler (A); and the process (2) of applying a thermosensitive color developing aqueous resin composition containing a thermosensitive color developing component in an aqueous solution or a water dispersion of a film-forming resin on the undercoat layer and drying the thermosensitive color developing aqueous resin composition to form a thermosensitive color developing layer.

Examples of the support used in the thermosensitive recording medium of the present invention include paper, various nonwoven fabric, woven fabric, synthetic resin film made of polyethylene terephthalate or polypropylene; paper, synthetic paper, metal foil or glass laminated with a synthetic resin such as polyethylene or polypropylene; and composite sheet obtained by combination thereof.

These supports may be opaque, transparent or translucent, or may include a white pigment, an organic dye and pigment or bubbles therein or on the surface in order to make the surface look white or other specific colors. When using a support having low hydrophilicity such as a film, the support is preferably subjected to a hydrophilization treatment of the surface due to corona discharge or easy adhesion treatment, such as applying thereto the film-forming resin (B) used in the undercoat layer. Also the support may be subjected to a treatment for static elimination or curl straightening.

The undercoat layer provided between the support and the thermosensitive color developing layer in thermosensitive recording medium of the present invention is a layer which is provided for the purpose of improving the dynamic color developing sensitivity to cope with high-speed driving with recent increase of the printing rate in the field of thermal facsimiles, and is provided to impart characteristics of adsorbing a thermosensitive color developing component in a hot molten state in order to impart excellent thermal insulation properties so as to effectively transport heat applied to the thermosensitive color developing layer from the thermal head without escaping to the support side and to prevent fixation of the color developer component molted by heating to the thermal recording equipment, thereby improving "head-matching properties".

In the prior art, voids were formed by adding a foamable plastic filler in tile undercoat layer to impart thermal insulation properties, while the filler was used to adsorb the thermosensitive color developing component, that is, two or more kinds of materials must be incorporated into the undercoat layer according to the purposes.

The largest feature of the present invention is that, by using a water-repellent filler (A) having a water-repellent surface, which is composed of at least one of an organosilicon compound and an organofluorine compound, microvoids are formed at the interface between the film-forming resin (B) constituting a matrix and the water-repellent filler (A) dispersed therein and the water-repellent filler (A) itself exhibits excellent absorptivity of the thermosensitive color developing component, that is, only the use of the film-forming resin (B) and the water-repellent filler (A) having a water-repellent surface makes it possible to obtain a thermosensitive recording medium, which meet the conditions of practical use, for example, excellent thermal insulation properties, high dynamic color developing sensitivity, sufficient resilience and excellent dot reproducibility.

The reason why voids are formed is not clear, but is considered to be as follows. In the process of applying an aqueous resin composition of the present invention on the support and drying the aqueous resin composition, water as a dispersion medium of the film-forming resin (B) is evaporated and volatilized in the state where the film-forming resin has poor ability with the surface of a filler having sufficient water repellency to form an undercoat layer containing a water-repellent filler (A) dispersed in a matrix of the film-forming resin (B).

At this stage, air included in the filler itself and the residual air in the mixing solution remain at the interface between the film-forming resin (B) and the water-repellent filler (A) and, as a result, an air layer, that is, microvoids having a size of about 5 to 150 μm are formed in the vicinity of the water-repellent filler (A).

Although conventionally used plastic spherical hollow particles exerted an adverse influence on the environment because carbon dioxide gas or organic gas is evolved during foaming, the aqueous resin composition used to form the undercoat layer of the thermosensitive recording medium of the present invention is environmentally friendly because it is free from a material which exerts an adverse influence on the environment.

As used herein, the thermosensitive color developing layer constituting the thermosensitive recording medium of the present invention is formed by applying a "thermosensitive color developing aqueous resin composition" containing a "dye precursor", as a coating solution prepared previously from a leuco dye and polyvinyl alcohol or water, and a thermosensitive color developing layer component mainly composed of a developer in an aqueous solution or a water dispersion of a film-forming resin on an undercoat layer or on another intermediate layer formed on the undercoat, which is described hereinafter. In the "dye precursor" or the "thermosensitive color developing aqueous resin composition", various conventional aqueous polymer compounds can be used and, for example, the above film-forming resin (B) can be used.

In the "thermosensitive color developing aqueous resin composition", auxiliary additive components, which are described as for the undercoat layer and are conventionally used in this kind of a thermosensitive recording medium, such as fillers, thermally fusible substances, surfactants and thickeners as well as various pigments can be used in combination.

As the leuco dye, there can be optionally used those which are applied in this kind of the thermosensitive recording medium and, for example, leuco compounds of dyes such as triphenylmethane, fluorine, phenothiazine, auramine, spiropyran and indolinophthalide are preferably used. Specific examples of the leuco dye include 3,3-bis(p-dimethylaminophenyl)-phthalide, 3,3-bis(p-dimethylaminophenyl)-6-dimethylaminophthalide (also called: crystal violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-{N-(3'-trifluoromethylphenyl)amino}-6-diethylaminofluoran, 2-{3,6-bis(diethylamino)-9-(o-chloroanilino)xanthyl}lactam benzoate, 3-diethylamino-6-methyl-7-(m-trichloromethylanilino)fluoran, 3-diethylamino-7-(o-chloroanilino)fluoran, 3-di-n-butylamino-7-(o-chloroanilino)fluoran, 3-N-methyl-N-n-amylamino-6-methyl-7anilinofluoran, 3-N-methyl-N-cyclohexylamino-6-methyl-7-anilinofluoran, 3-diethylamino-6-methyl-7-anilinofluoran, 3-diethylamino-6-methyl-7-anilinofluoran, 3-(N,N-diethylamino)-5-methyl-7-(N,N-dibenzylamino)fluoran, benzoyl leucomethylene blue, 6'-chloro-8'-methoxy-benzoindolino-spiropyran, 6'-bromo-3'-methoxy-benzoindolino-spiropyran, 3-(2'hydroxy-4'-dimethylaminophenyl)-3-(2'-methoxy-5'-chlorophenyl)phthalide, 3-(2'hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-(N-ethyl-N-tetrahydrofurfuryl)amino-6-methyl-7-anilinofluoran, 3-N-ethyl-N-(2-ethoxypropyl)amino-6-methyl-7-anilinofluoran, 3-N-methyl-N-isobutyl-6-methyl-7-anilinofluoran-3-morpholino-7-(N-propyl-trifluoromethylanilino)fluoran, 3-pyrrolidino-7-m-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino)fluoran, 3-(N-methyl-N-isopropylamino)-6-methyl-7-anilinofluoran, 3-di-n-butylamino-6-methyl-7-anilinofluoran, 3,6-bis(dimethylamino)fluorenespiro(9,3')-

6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-diethylamino-6-methyl-7-mesitidino-4',5'-benzofluoran, 3-N-methyl-N-isopropyl-6-methyl-7-anilinofluoran, 3-N-ethyl-N-isoamyl-6-methyl-7-anilinofluoran and 3-diethylamino-6-methyl-7-(2',4'-dimethylanilino)fluoran. These leuco dyes may be used alone, or two or more kinds of them may be used in combination.

Examples of the developer used in the thermosensitive color developing layer in the thermosensitive recording medium of the present invention include various electron-accepting compounds, or oxidizer capable of making the leuco dye develop a color when contacted. Specific examples thereof include 4,4'-isopropylidenediphenol, 4,4'-isopropylidenebis(o-methylphenol), 4,4'-sec-butylidenebisphenol, 4,4'-isopropylidenebis(2-tert-butylphenol), zinc p-nitrobenzoate, 1,3,5-tris(4-tert-butyl-3-hydroxy-2,6-dimethylbenzyl)isocyanuric acid, 2,2-(3,4'-dihydroxydiphenyl) propane, bis(4-hydroxy-3-methylphenyl)sulfide, 4-{β-(p-methoxyphenoxy)ethoxy}salicyclic acid, 1,7-bis(4-hydroxyphenylthio)-3,5-dioxaheptane, 1,5-bis(4-hydroxyphenylthio)-5-oxapentane, monobenzyl monophthalate ester mono-calcium salt, 4,4'-cyclohexylidenediphenol, 4,4'-isopropylidenebis(2-chlorophenol), 2,2'-methylenebis(4-methyl-6-tert-butylphenol), 4,4'-butylidenebis(6-tert-butyl-2-methyl)phenol, 1,1,3-tris(2-methyl-4-hydroxy-5-tert-butylphenyl)butane, 1,1,3tris(2-methyl-4-hydroxy-5-cyclohexylphenyl)butane, 4,4'-thiobis(6-tert-butyl-2-methyl)phenol, 4,4'-diphenolsulfone, 4-isopropoxy-4'-hydroxydiphenylsulfone, 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,3-bis(4-hydroxyphenylthio)-propane, N,N'-diphenylthiourea, N,N'-di(m-chlorophenyl)thiourea, salicylanilide, bis-(4-hydroxyphenyl)methyl acetate, bis-(4-hydroxyphenyl) benzyl acetate, 1,3-bis-(4hydroxycumyl)benzene, 1,4-bis(4-hydroxycumyl)benzene, 2,4'-diphenolsulfone, 2,2'-diallyl-4,4'-diphenolsulfone, 3,4-dihydroxyphenyl-4'-methyldiphenylsulfone, zinc 1-acetyloxy-2naphthoate, zinc 2-acetyloxy-1-naphthoate, zinc 2-acetyloxy-3-naphthoate, α,α-bis(4-hydroxyphenyl)-α-methyltoluene, antipyrine complex of zinc thiocyanate, tetrabromobisphenol A, tetrabromobisphenol S, 4,4'-thiobis(2-methylphenol) and 4,4'-thiobis(2-chlorophenol). These developers may be used alone, or two or more kinds of them may be used in combination.

Also a layer containing aqueous polymer compounds, fillers, pigments, thermally fusible substances and thickeners etc. can be optionally provided, as the other intermediate layer, between the undercoat layer and the thermosensitive color developing layer of the thermosensitive recording medium of the present invention. In this case, the same aqueous polymer compounds, fillers, pigments, thermally fusible substances and thickeners as those described above can be used.

Furthermore, in the thermosensitive recording medium of the present invention, a protective layer can be provided on the thermosensitive color developing layer for the purpose of improving matching properties with the thermal head and enhancing storage stability of recorded images. As the component constituting the protective layer, the same aqueous polymer compounds, fillers, pigments, surfactants, thermally fusible substances and thickeners as those described above can be used.

The filler used in the thermosensitive color developing layer, other intermediate layer and the protective layer is not limited to the filler having high water repellency used in the aqueous resin composition, and any convivially known filler can be used.

The method of coating the aqueous resin composition and the thermosensitive color developing aqueous resin composition used in the production of the thermosensitive recording medium of the present invention is not specifically limited and a conventional method may be used. For example, coating apparatuses such as an air knife coater, blade coater, bar coater and flood coater and various lithographic, letterpress, intaglio, flexographic, gravure and screen printing presses can be used.

Specific examples of the method of preparing a thermosensitive color developing aqueous resin composition containing the dye precursor and the developer as a main component include, but are not limited to, a method of mixing compounds after separately dispersing in a dispersion medium and a method of uniformly dissolving compounds with heating, cooling the mixture and dispersing the mixture in a dispersion medium.

A print with images can be obtained by heating the thermosensitive recording medium of the present invention using a thermal recording device such as a thermal head, thereby making a thermosensitive color developing layer of the thermosensitive recording medium to develop a color.

The thermosensitive recording medium of the present invention can be used as materials on which images are formed of prepaid cards, passes, admission tickets, tickets, papers for facsimile, output papers for electronic computer, and tape- or sheet-like forms such as receipt.

EXAMPLES

The present invention will now be described in detail by way of Examples and Comparative Examples. In the following Examples and Comparative Examples, percentages and parts are by weight unless otherwise specified.

With respect to the thermosensitive recording papers obtained in the Examples described hereinafter, dynamic color developing sensitivity, image uniformity and head-matching properties were tested and evaluated.

The respective tests were conducted when the thermosensitive recording medium was printed under the conditions of an input voltage of 0.7 W/dot, a main scanning recording rate of 10 msec/line, a subscanning line density of 7.7 line/mm and a printing pulse width of 0.3, 0.35 and 0.4 msec using a printing test apparatus equipped having a thermal head of 8 dot/mm manufactured by Matsushita Electronic Components Co., Ltd. The color developing density was measured by a Macbeth densitometer (RD-514, filter wratten-106).

The dynamic color developing sensitivity, the image uniformity and the head-matching properties are evaluated according to the following criteria.

[Criteria for Evaluation of Dynamic Color Developing Sensitivity]

The dynamic color developing sensitivity was measured by a Macbeth densitometer (RD-514, filter wratten-106) when printing was conducted under the conditions of an input voltage of 0.7 W/dot, a main scanning recording rate of 10 msec/line, a subscanning line density of 7.7 line/mm and a printing pulse width of 0.3, 0.35 and 0.4 msec using the above printing test apparatus.

Higher value of the dynamic color developing sensitivity means better color developability.

[Criteria for Evaluation of Image Uniformity]

○: no bleeding and uniform image

X: slight or more bleeding and non-uniform image

[Criteria for Evaluation of Head-matching Properties]

Head-matching properties were visually evaluated by the amount of the residue adhered to the thermal head after the printing test.

○: amount of the residue adhered to the thermal head is very small x: adverse influence is exerted on thermal head running properties because of large amount of the residue adhered to the thermal head Example 1

(Aqueous Resin Composition for Undercoat Layer)

5 Parts of inorganic water-repellent silica whose surface was treated with trimethylsilane, which has an average particle diameter of 16 nm and a moisture adsorption ratio as measured under the conditions of a temperature of 20° C. and a relative humidity 80% of 0.8% by weight, and 100 parts of a polyurethianie resin aqueous dispersion (resin solid content: 20%) were dispersed in a homogenizer to prepare an aqueous resin composition for undercoat layer (L solution). The L solution was applied on the surface of a commercially available wood free paper (basis weight: 52 g/m$^2$) in a dry coating weight of 3 g/m$^2$ and moisture was evaporated by maintaining in an atmosphere at 100° C. for 3 minutes to form voids, and thus a paper coated with an undercoat layer was produced.

(Production of Thermosensitive Recording Medium)

Separately, a dye precursor (M solution) was prepared by mixing and dispersing 20 parts of 3-(N-cyclohexyl-N-methyl)amino-6-methyl-7-anilinofluoran, 20 parts of an aqueous 10% polyvinyl alcohol solution and 60 parts of water and a developer dispersion (N solution) was prepared by mixing and dispersing 20 parts of benzyl p-hydroxybenzoate, 10 parts of calcium carbonate, 30 parts of an aqueous 10% polyvinyl alcohol solution and 40 parts of water. The M solution and the N solution were mixed in a weight ratio of 1:3 and stirred to obtain a thermosensitive color developing aqueous resin composition. The thermosensitive color developing aqueous resin composition was applied on the paper coated with an undercoat layer in a dry coating weight of 3 g/m$^2$ and then dried to obtain a thermosensitive recording paper as the thermosensitive recording medium of the present invention. Hereinafter, the resulting thermosensitive recording paper is referred to as a thermosensitive recording paper (X-1).

Example 2

(Aqueous Resin Composition for Undercoat Layer)

In the same manner as in Example 1, except that a methylsilicone powder having an average particle diameter of 3 μm as an organic filler was used in place of the inorganic water-repellent silica in the L solution in Example 1, an aqueous resin composition for undercoat layer of the present invention was obtained.

(Production of Thermosensitive Recording Medium)

In the same manner as in Example 1, a thermosensitive recording paper was obtained using the above composition. Hereinafter, the resulting thermosensitive recording paper is referred to as a thermosensitive recording paper (X-2). The moisture adsorption ratio of the methylsilicone powder was 1.2% by weight under the conditions of a temperature of 20° C. and a relative humidity of 80%.

Example 3

(Aqueous Resin Composition for Undercoat Layer)

In the same manner as in Example 1, except that an acrylic emulsion (resin solid content: 20%) was used in place of the polyurethianie resin aqueous dispersion in the L solution in Example 1, an aqueous resin composition for undercoat layer of the present invention was obtained.

(Production of Thermosensitive Recording Medium)

In the same manner as in Example 1, a thermosensitive recording paper was obtained using the above composition. Hereinafter, the resulting thermosensitive recording paper is referred to as a thermosensitive recording paper (X-3).

Example 4

(Aqueous Resin Composition for Undercoat Layer)

In the same manner as in Example 1, except that the amount of the inorganic water-repellent silica in the L solution in Example 1 was replaced by 20 parts, an aqueous resin composition for undercoat layer of the present invention was obtained.

(Production of Thermosensitive Recording Medium)

In the same manner as in Example 1, a thermosensitive recording paper was obtained using the above composition. Hereinafter, the resulting thermosensitive recording paper is referred to as a thermosensitive recording paper (X-4).

Comparative Example 1

(Aqueous Resin Composition for Undercoat Layer)

In the same manner as in Example 1, except that an inorganic hydrophilic silica, which has an average particle diameter of 12 nm and a moisture adsorption ratio as measured under the conditions of a temperature of 20° C. and a relative humidity of 80% of 4% by weight was used in place of tie inorganic water-repellent silica in the L solution in Example 1, an aqueous resin composition for undercoat layer of the present invention was obtained.

(Production of Thermosensitive Recording Medium)

In the same manner as in Example 1, a thermosensitive recording paper was obtained using the above composition. Hereinafter, the resulting thermosensitive recording paper is referred to as a thermosensitive recording paper (Y-1).

Comparative Example 2

In the same manner as in Example 1, except that the inorganic water-repellent silica in the L solution in Example 1 was not used and only a polyurethane resin aqueous dispersion (resin solid content: 20%) was used, an aqueous resin composition for undercoat layer of the present invention was obtained.

(Production of Thermosensitive Recording Medium)

In the same manner as in Example 1, a thermosensitive recording paper was obtained using the above composition. Hereinafter, the resulting thermosensitive recording paper is referred to as a thermosensitive recording paper (Y-2).

TABLE 1

| Test No. of Table 1 | Thermosensitive recording paper | Dynamic color developing sensitivity (msec) 0.3 | 0.35 | 0.4 | Image uniformity | Head-matching properties |
|---|---|---|---|---|---|---|
| Example 1 | X-1 | 0.73 | 1.07 | 1.37 | ○ | ○ |
| Example 2 | X-2 | 0.72 | 1.06 | 1.35 | ○ | ○ |
| Example 3 | X-3 | 0.70 | 1.05 | 1.36 | ○ | ○ |
| Example 4 | X-4 | 0.75 | 1.07 | 1.37 | ○ | ○ |
| Comparative Example 1 | Y-1 | 0.33 | 0.47 | 0.68 | X | X |
| Comparative Example 2 | Y-2 | 0.31 | 0.44 | 0.65 | X | X |

The aqueous resin composition of the present invention can exert excellent effects capable of forming an undercoat layer having microvoids and excellent thermal insulation properties only by applying the aqueous resin composition on the support and drying the aqueous resin composition, and also has such an advantage that it does not contain a foamable plastic filler capable of evolving a carbon dioxide gas or an organic gas and therefore exerts no adverse influence on the environment. The thermosensitive recording medium of the present invention has an undercoat layer leaving microvoids and excellent thermal insulation properties and therefore has high dynamic color developing sensitivity and excellent head-matching properties and is capable of recording uniform and clear images with high density.

The invention claimed is:

1. A thermosensitive recording medium comprising a support, and an undercoat layer and a thermosensitive color developing layer, which are sequentially laminated on the support, wherein the undercoat layer is composed of a matrix of a film-forming resin (B) and a water-repellent filler (A) dispersed in the matrix, the water-repellent filler (A) having a water-repellent surface composed of at least one of an organosilicon compound and an organofluorine compound, and also has microvoids at the interface between the matrix and the water-repellent filler (A).

2. The thermosensitive recording medium according to claim 1, wherein the thermosensitive color developing layer contains a leuco dye and a developer.

3. The thermosensitive recording medium according to claim 1, wherein a moisture adsorption ratio of the water-repellent filler (A) is at most 2.0% by weight under the conditions of a temperature of 20° C. and a relative humidity of 80%.

4. The thermosensitive recording medium according to claim 1, wherein the water-repellent filler (A) is silica whose surface is treated with at least one of an organosilicon compound and an organofluorine compound, or a methyl-silicone resin.

5. The thermosensitive recording medium according to claim 1, wherein the film-forming resin (B) is at least one member selected from the group consisting of polyurethane resin, poly(meth)acrylate ester, styrene-butadiene copolymer, acrylonitrile-butadiene copolymer and (meth)acrylate ester-butadiene copolymer.

6. The thermosensitive recording medium according to claim 1, wherein the amount of the water-repellent filler (A) is within a range from 3 to 100 parts by weight based on 100 parts by weight of the film-forming resin (B).

* * * * *